United States Patent [19]

Mackay et al.

[11] 4,234,526

[45] Nov. 18, 1980

[54] EVAPORATIVE COOLER

[75] Inventors: Frederick G. Mackay, Tarzana; Spencer L. Mackay, Canoga Park, both of Calif.

[73] Assignee: McGraw-Edison Company, Rolling Meadows, Ill.

[21] Appl. No.: 2,125

[22] Filed: Jan. 9, 1979

[51] Int. Cl.[2] ..... B01F 3/04

[52] U.S. Cl. ..... 261/106; 62/315; 62/DIG. 16; 98/2.11; 261/29; 261/DIG. 4; 261/DIG. 41; 312/31.06; 312/236

[58] Field of Search ..... 261/24, 29, 97, 98, 261/30, 103, 106, DIG. 4, DIG.15, DIG. 41; 98/2.11, 2.14; 62/314–316, DIG. 16; 312/31.01–31.06, 31.1–31.3, 30, 236

[56] References Cited

U.S. PATENT DOCUMENTS

| | | | |
|---|---|---|---|
| 2,631,831 | 3/1953 | Robic | 261/30 |
| 3,698,158 | 10/1972 | Kinnebrew | 261/98 X |
| 3,738,621 | 6/1973 | Anderson | 261/29 |
| 3,867,486 | 2/1975 | Nagele | 261/DIG. 4 |
| 3,953,551 | 4/1976 | Dorall | 261/DIG. 4 |
| 3,978,174 | 8/1976 | Peer | 261/DIG. 4 |
| 4,026,971 | 5/1977 | Glasoe | 261/DIG. 4 |
| 4,029,723 | 6/1977 | Morrison et al. | 261/DIG. 41 |
| 4,045,523 | 8/1977 | Goettl | 261/DIG. 41 |
| 4,080,410 | 3/1978 | Goettl | 261/DIG. 41 |

*Primary Examiner*—Richard L. Chiesa
*Attorney, Agent, or Firm*—Ronald J. LaPorte; Dale A. Kubly; Jon C. Gealow

[57] ABSTRACT

An evaporative cooler having a one-piece, frameless shell secured to a bottom pan and having a top cover hinged along one edge to the side wall of the housing shell. A quick-release latching mechanism secures the top cover to the opposite side wall to hold the top cover closed while permitting the top cover to be easily opened for access to components of the evaporative cooler housed therein. Evaporative media pad assemblies have side frame members having V-shaped outer surfaces which slide in correspondingly shaped tracks in the corners of the shell to space the pad assemblies from the louvered side walls of the shell and permit the pad assemblies to be installed and removed from above with a vertical sliding movement.

7 Claims, 8 Drawing Figures

EVAPORATIVE COOLER

BACKGROUND OF THE INVENTION

This invention relates generally to evaporative coolers and more particularly to an improved evaporative cooler wherein the top cover is hinged to the one-piece, frameless shell of the cooler housing and held in the closed position by a latching mechanism and wherein the evaporative pad assemblies and other components are easily removable from above when the top cover is open without further disassembly of the cooler.

Reference may be made to the following U.S. Pat. Nos. 4,080,410; 4,029,723; 3,290,020; 3,075,750; and 2,631,831. Also of general interest are the following U.S. Pat. Nos. 4,026,971; 3,978,174; 3,953,551; 3,867,486; 3,738,621; and 3,698,158.

Evaporative coolers, such as those disclosed in the aforementioned references, utilize the well-known principle of heat absorption by moisture evaporation to cool or condition hot, dry ambient air from the outside prior to its delivery into an enclosure such as a mobile home or a building. The basic components of an evaporative cooler generally include an outer housing including a shell which encloses evaporative pads, a water pump and distribution system to wet the evaporative pads, and a motor-driven blower or fan which draws the hot, dry ambient air through louvered side wallls of the shell and the moistened pads, causing evaporation of the water from the pads. As the water evaporates, the heat is absorbed from the ambient air and the evaporatively-cooled air is then directed into the enclosure through a duct leading from the cooler.

Because the surface area of the wetted pads must be significant to provide sufficient cooling capacity, evaporative coolers which are presently available are relatively large and commonly have a cube-like appearance with each side being approximately three to four feet across. When installed, such evaporative coolers are typically located on the roof or the side of the enclosure to pass cooled air through either an existing window or an opening specially provided in the ceiling or wall.

A common disadvantage of presently-available evaporative coolers, however, is the difficulty encountered in performing the maintenance and repair these devices typically require such as in replacing the evaporative pads or repairing or maintaining the motor-driven blower assembly and other components. In particular, access to the evaporative pads and the other components housed in the cooler housing is limited, unintentionally, of course, by the design of the unit and the manner in which it is constructed. Such devices have commonly provided a bottom sump pan serving as a water reservoir and have a centrally located riser to which the motor-driven blower is assembled. Exterior louvered panels or the like are typically secured, such as by bolts, to corner frame members extending upwardly from the sump pan or by virtue of an interference fit with an overlapping top cover, and the top cover typically is secured to the unit by the aforementioned interference fit or by bolts. In some prior coolers, the evaporative pads have been assembled to the louvered panels in an immediately adjacent or spaced relation and secured to the corner frame members such that the panels must be removed to gain access to the pad assemblies for replacement of the pads. Even with the louvered panel and the pad assembly removed, however, access to the interior of the unit for performing maintenance or repair of the other components, for example, the motor-driven blower, the water distribution system or the like, is usually limited. Consequently, maintenance and repair are somewhat more difficult than is desirable. In fact, because of the inaccessable nature of many of the components, such as the blower system, it is common to have the blower assembly and other components somewhat permanently mounted to the structure by tabs or bolts. Thus, in order to remove a particular component, part of the structure itself, such as the securing tabs, must be deformed or unbolted from the side. This naturally discourages proper maintenance and/or repair. Moreover, when the louvered panels are removed and laid aside while the pads are replaced or work is performed on the other components, the panels may be inadvertently dented or scratched, marring the exterior appearance of the unit.

Alternatively, in some evaporative coolers, it may be necessary to remove the top cover from the unit to gain access to the evaporative pads and the other components. Even then it is usually necessary to disassemble the pads from the louvered panels or the corner frame members to permit removal of the evaporative pads. Also, in order to remove the blower assembly, as may be required at times, the securing tabs must be released, or if the blower assembly is bolted to the riser, the bolts must be removed. Not only is removal of the blower assembly difficult because the bolts are usually installed horizontally, it is even more difficult to reassemble the blower assembly to the riser because the holes for the bolts, or sheet metal screws, in the side of the blower assembly and the side of the riser must be realigned from a vantage point above the unit. Of course, when the top cover is removed, it may be inadvertently knocked to the ground from the roof on which the evaporative cooler may be located, and the resulting damage to the top cover may require its repair, especially where an interference fit is relied upon to secure the top cover in position on the cooler.

SUMMARY OF THE INVENTION

In accordance with the present invention, the evaporative cooler hereinafter disclosed obviates the aforementioned disadvantages of prior coolers and provides an evaporative cooler which is more easily serviced and repaired.

More particularly, the present invention discloses an evaporative cooler having an outer housing comprising a bottom pan, an open-ended, one-piece, frameless shell having louvered side walls, the open bottom end of which is secured to the bottom pan, and a top cover adapted to close the open top end of the shell. A riser extends upwardly from the bottom wall of the bottom pan and opens therethrough to provide an opening for discharging cooled air into the enclosure and a motor-driven blower is mounted on the riser to draw hot, dry ambient air into the cooler through the louvered side walls and wetted evaporative pads spaced inwardly from the side walls. The air thus cooled by evaporation of water from the pads is discharged by the blower through a discharge outlet communicating with the riser opening through the bottom wall of the bottom pan. In accordance with one aspect of the present invention, a frame for supporting the evaporative pad in the housing comprises a top trough member overlying the pad, a bottom member, and a pair of side frame members. Means including T-shaped rails are provided at the corners of the one-piece, frameless shell and angled with respect to the side walls to provide V-shaped tracks at each corner for the adjacent side walls. Thus, the rails provided at adjacent corners define opposed V-shaped tracks for the evaporative pad frame assembly associated with each side wall, the side frame members providing outer V-shaped surfaces which are slidably received in the opposed tracks to locate the evaporative pad assemblies within the housing and spaced inwardly from the corresponding louvered side wall. Accordingly, the evaporative pad assemblies can be easily removed from the cooler housing by lifting from above to slide the assemblies from the tracks thereby facilitating the replacement of the evaporative pads. The top frame member also advantageously provides a trough for receiving water from an overlying water distribution tube which is coupled by a flexible hose to an electric water pump having an inlet residing in a water reservoir defined by the bottom pan. In operation, water is pumped from the reservoir in the bottom pan and distributed to the troughs where the water is released through openings in the bottoms of the troughs to saturate the underlying evaporative pads.

In accordance with another aspect of the invention, the top cover is hinged along one side wall to the open top end of the housing shell to permit the top cover to be moved from a closed position directly overlying the open top end of the housing shell to a removed, or open, position away from the top end of the shell. When the top cover is moved to the open position, access to the interior of the cooler housing is maximized, and the evaporative pad assemblies can be easily slid from their opposed tracks. This also has the advantage that the top cover is less likely to be damaged because it is secured at all times to the housing.

Latching means are also provided for latching the opposite side of the top cover to the opposing side wall when the top cover is closed. The latching means of the present invention provides a simplified mechanism requiring only the use of a screw driver to latch the top cover in the closed position or to release the latch to allow the cover to be opened. In particular, the latching means comprises a latch member having a top member on the top side of a horizontal flange extending inwardly from the side wall and a bottom member on the bottom side of the flange. A slot is provided in the flange, and means are provided to extend through the slot and secure the top member to the bottom member such that the latch member is slidable therein between open and closed positions. A lip is provided on the top member to engage a corresponding horizontal flange extending inwardly from the peripheral edge of the top cover, and means including a screw extend through the side wall to threadably engage the bottom member of the latch and, responsive to rotation of the screw, move the latch member transversely to engage or disengage the lip from the cover flange as required.

Still another aspect of the present invention, is the provision of clamps for releasably securing the blower to the riser. In the embodiment hereinafter shown, each clamp comprises a pair of opposed upper and lower C-shaped clamp members having web portions having horizontally depending flanges at their respective inner and outer sides. The inner flanges of the top and bottom clamp members are positioned on opposite sides of a peripheral flange extending outwardly from the bottom of the blower housing and a horizontal flange at the top end of the riser underlying the blower housing flange. The outer flanges of the upper and lower clamp members abut and have interlocking notch portions and tab portions. The webs of the C-clamp members are spaced apart and connected by a bolt or other suitable means which tightens the clamp members together to draw the inner flanges thereof together with the blower housing flange and the riser flange clamped therebetween. A gasket is also provided between the blower housing flange and the riser flange. The clamps thus provided therefore allow for the easy installation of the blower to the riser from above.

Accordingly, the aforementioned features of the present invention combine to provide an evaporative cooler which is easier to maintain and repair than coolers heretofore available.

BRIEF DESCRIPTION OF THE DRAWING

The features of this invention which are believed to be novel are set forth with particularity in the appended claims. The invention, together with its further objects and the advantages thereof, may be best understood, however, by reference to the following description taken in conjunction with the accompanying drawings, in which like reference numerals identify like elements in the several figures and in which:

DETAILED DESCRIPTION

Figures 1, 8:
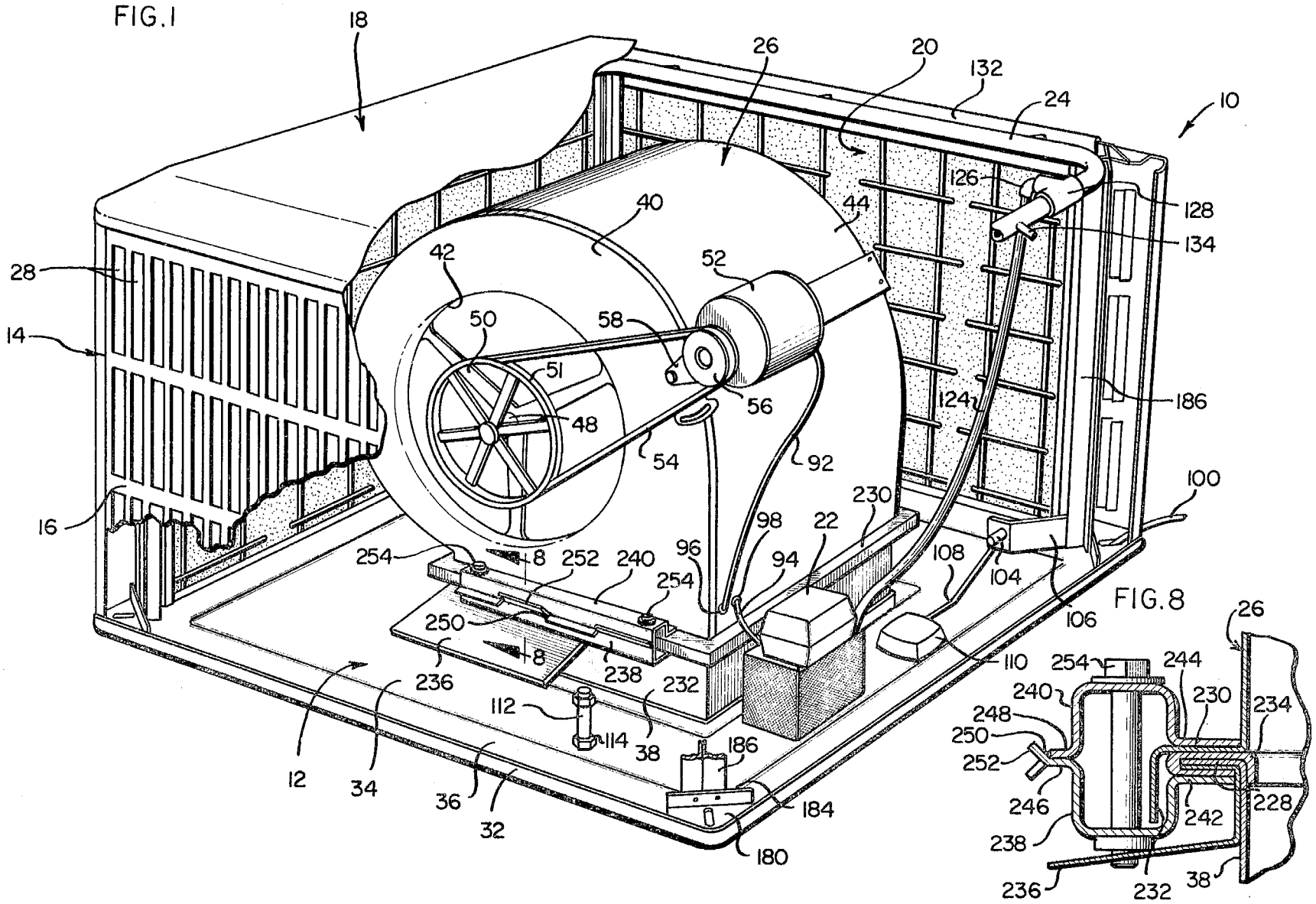
FIG. 1 is a perspective view of an evaporative cooler incorporating the features of the present invention wherein portions of the outer cooler housing shell and the cover have been broken away and certain ones of the evaporative media pad assemblies have been removed for purposes of clarity.
FIG. 8 is a sectional view taken along line 8—8 in FIG. 1 showing clamp means for clamping the blower to the riser.

With reference now to the drawings, the evaporative cooler shown therein and identified generally by reference numeral 10 is adapted to be mounted on the roof of an enclosure, such as a mobile home, which is to be cooled by conditioned air from the cooler.

Figure 2:
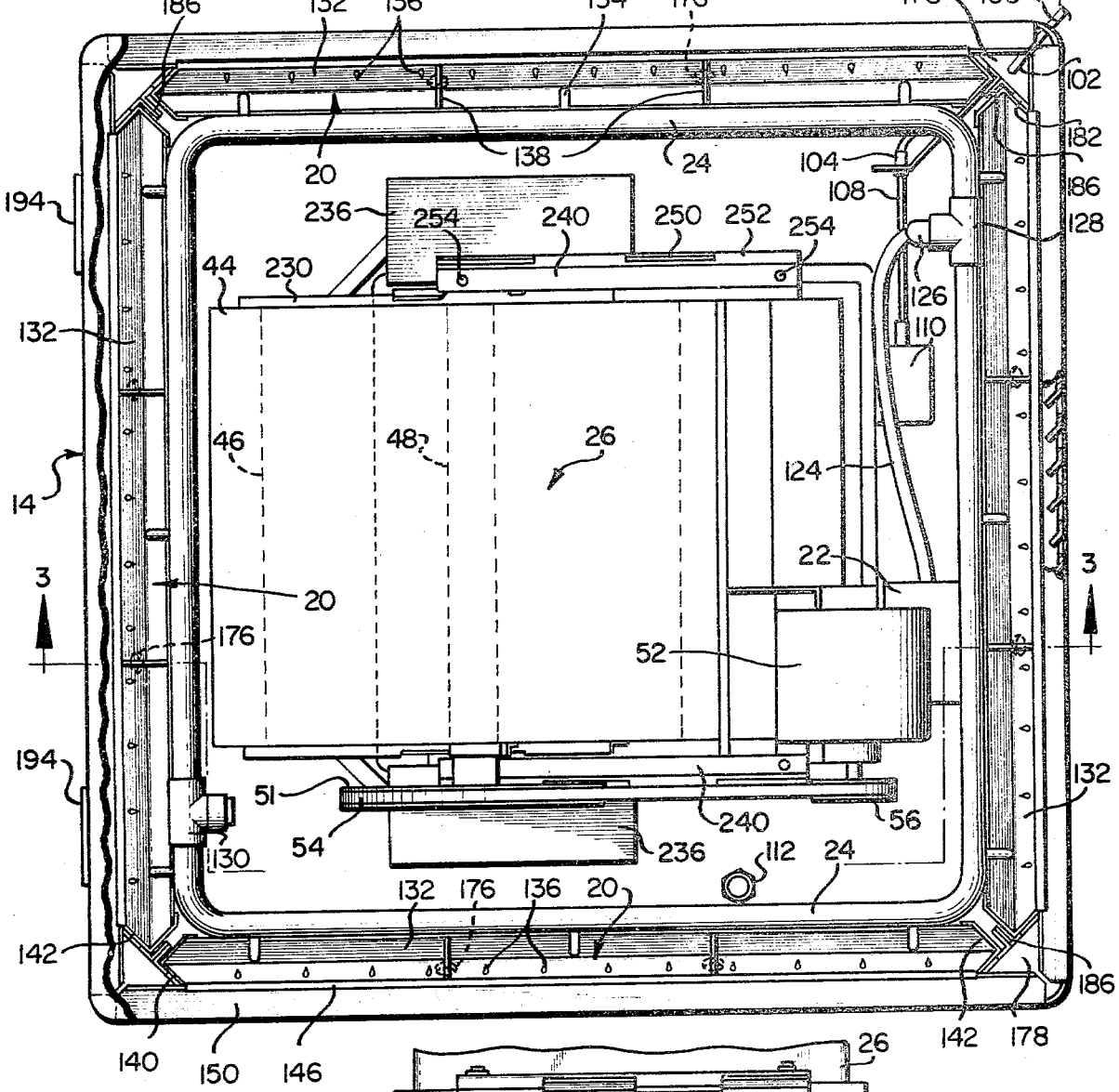
FIG. 2 is a top plan view of the evaporative cooler shown in FIG. 1 with the cover broken away to show the evaporative pad assemblies installed in the vertical tracks and the disposition of the water distribution system relative to the pad structure and to further show the general arrangement of the components comprising the evaporative cooler.
Figure 3:
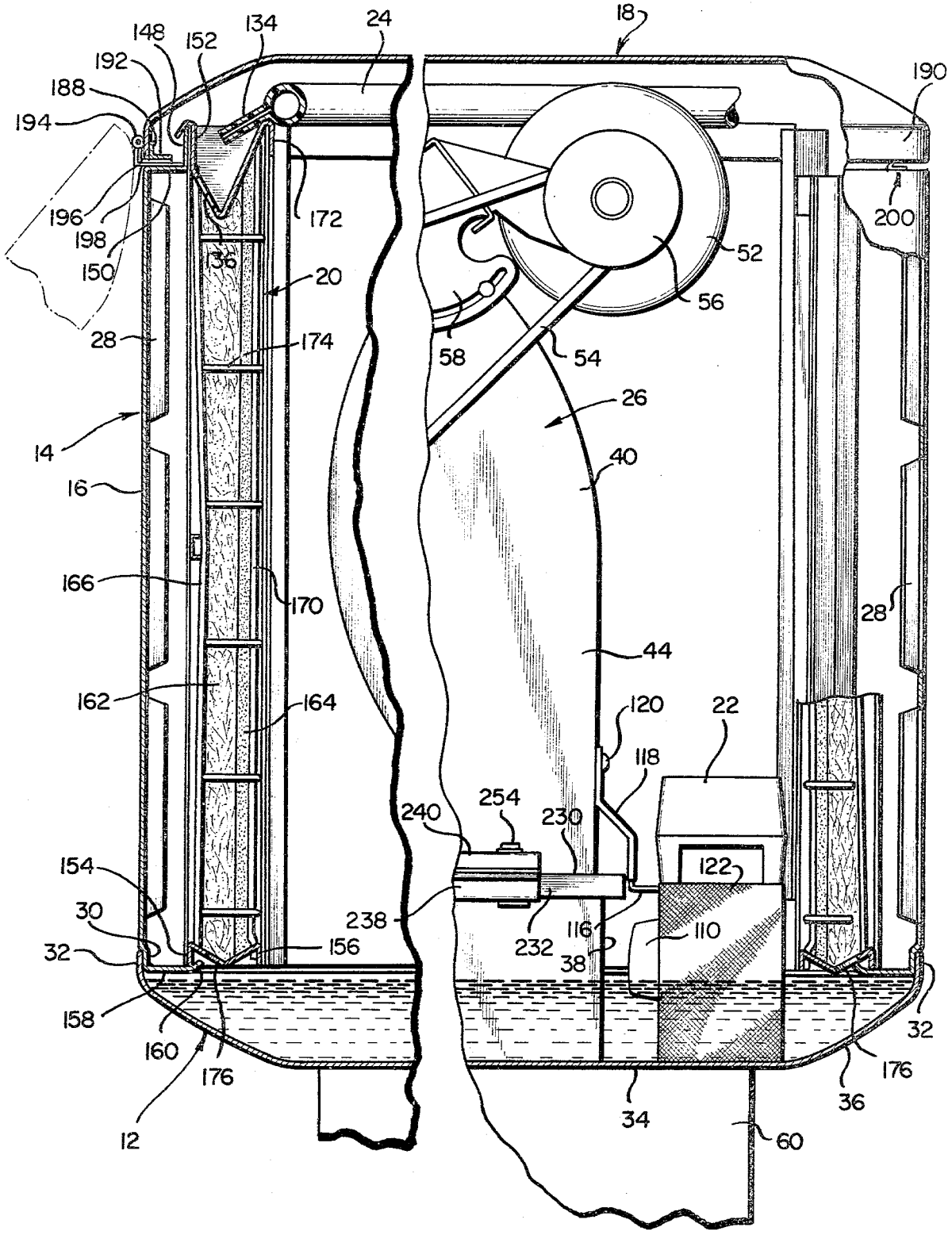
FIG. 3 is a sectional view taken along line 3—3 in FIG. 2, with the center portion of the cooler broken away, to illustrate the hinging and cover latching mechanism comprising one aspect of the present invention.
Figure 5:
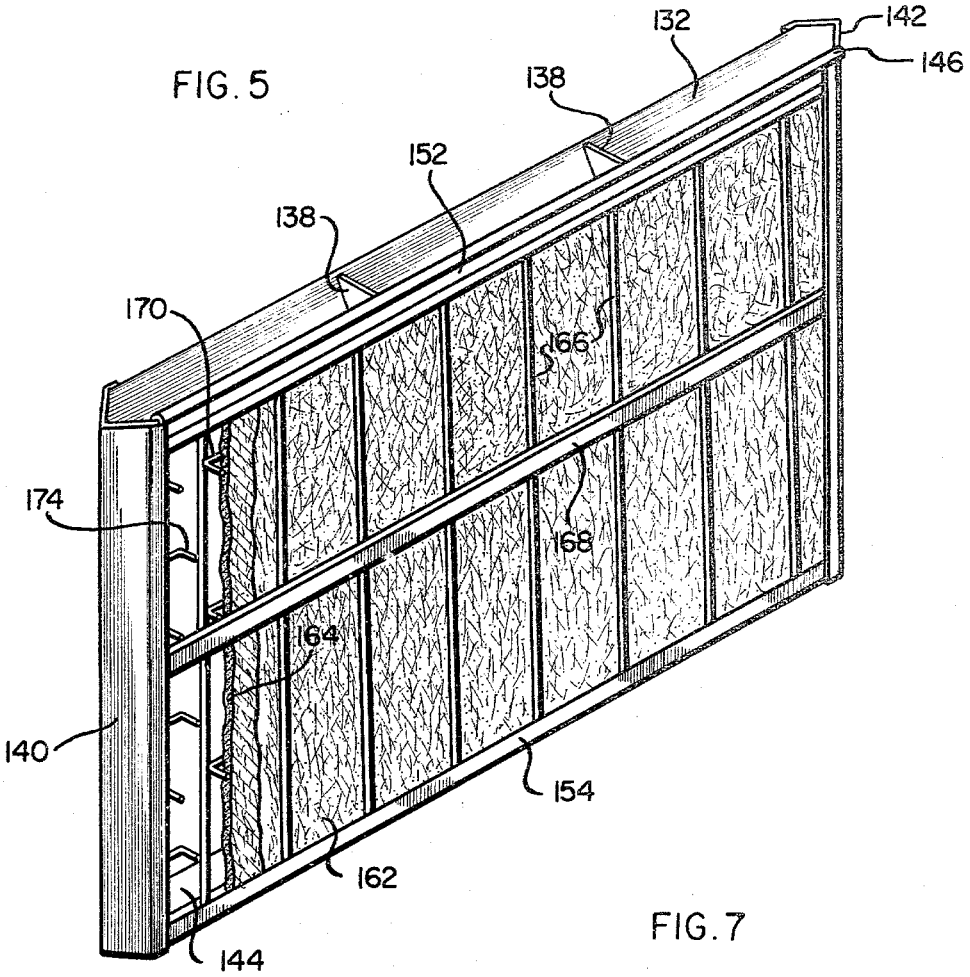
FIG. 5 is a perspective view of one of the evaporative media pad assemblies partially broken away to further show the construction of the pad assembly in greater detail.

In FIGS. 1–3, it may be seen that the cooler 10 basically includes an outer housing comprising a shallow, watertight bottom pan 12 which also serves as sump, or water reservoir, an intermediate one-piece, open-ended rectangular shell 14 comprising four interconnected louvered side walls 16, and a top cover 18. As in conventional coolers of this type, evaporative media pad assemblies 20 are positioned adjacent each side wall 16, in this embodiment, in spaced relation thereto, and moistened with water pumped from the reservoir by an electric pump 22 and distributed to the pad assemblies via an overlying water distribution tube 24. Hot, dry ambient air from the outdoors is drawn into the cooler through the louvered side walls 16 and the wetted evaporative media pad assemblies 20 by a motor-driven blower 26 and cooled in the well-known manner by evaporation of the water from the wetted media pad assemblies before discharge as conditioned air into the enclosure.

The shell 14 may be initially stamped from a single, flat piece of sheet metal and includes a plurality of inwardly turned louvers 28 arranged, for example, in several rows across the face of each side wall 16 to permit air to be optimumly drawn into the cooler during its operation. After stamping, the piece is bent to form the generally open-ended rectangular shell 14 illustrated in the drawings and the two side walls 16 at the ends of the piece are joined, such as by spot welding or the like, at one corner to provide the one-piece frameless side wall shell construction. At its bottom, the shell 14 provides a peripheral, inwardly offset side wall portion 30 dimensioned to fit within the bottom pan 12 in an interference fit.

The bottom pan 12 also comprises a one-piece component that can be stamped from sheet metal or similarly fabricated from any other suitable water impervious material such as plastic. In the particular embodiment shown in the drawings, the bottom pan 12 has a generally rectangular configuration dimensioned to receive the offset wall portion 30 of the open bottom end of the shell 14 and, in particular, comprises an upstanding peripheral wall portion 32 for retaining the offset wall portion of the shell in an interference fit and a centrally located rectangular bottom wall portion 34 integrally coupled to the peripheral wall portion by connective intermediate sloped wall portions 36. Although the shell 14 is generally held securely in position on the bottom pan 12 by virtue of the interference fit, additional securement can be provided, if necessary, by sheet metal screws, spot welding or the like.

An open-ended riser 38 secured to the bottom wall 34 of the pan, such as by welding, extends upwardly from the bottom wall to provide, at its open bottom end, a discharge opening through the bottom wall of the pan and to define the interior walls of the water reservoir. At its open top end, the riser 38 communicates with the discharge outlet of the blower 26 which is mounted on the riser.

The blower 26 is of conventional design and generally includes a sheet metal housing comprising opposed end walls 40 with air inlet openings 42 provided therein and a curvilinear shroud 44 forming the other outer surface of the housing. Located within the housing is a squirrel cage blower wheel 46 which is secured to and rotatable with a shaft 48 carried by spider bearing assemblies 50 mounted across the air inlet openings 42 in the end wallls of the housing. A pulley 51 is secured to one end of the shaft 48 externally of the housing and coupled to an electric motor 52 by a drive belt 54 which is looped around a sheave 56 mounted on the drive shaft of the motor. The motor 52, in turn, is mounted on an adjustable motor support bracket 58 secured to the blower housing to facilitate the adjustment of the belt tension which, of course, must be maintained on a continuing basis.

Accordingly, when the motor 52 is connected to an alternating current power source during operation of the cooler, the blower wheel 46 is driven by the motor to draw hot, dry ambient air into the cooler through the louvered side walls 16 and the wetted evaporative media pad assemblies 20 where it is cooled and then into the blower housing through the air inlet openings 42. As the blower wheel 46 rotates, the cooled air is moved in a direction which is generally tangential to the interior of the curved shroud 44 and discharged through an outlet opening of generally rectangular configuration communicating with the open top end of the riser 38.

Figure 4:
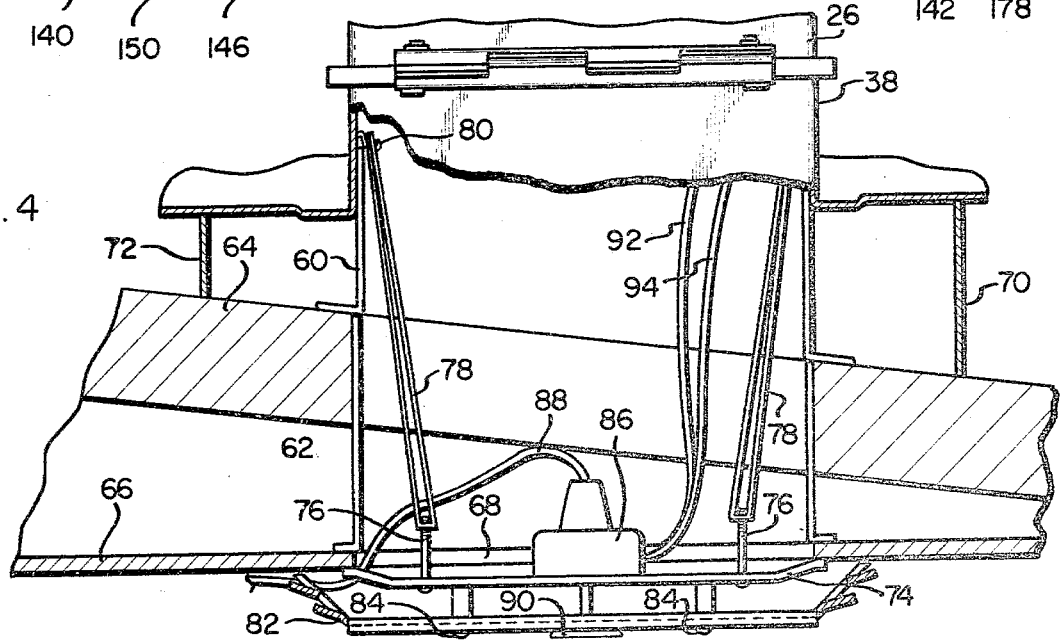
FIG. 4 is a partial side elevational view, partly in section, showing the evaporative cooler mounted on the roof of an enclosure such as a mobile home, and illustrating the manner in which cooled air is discharged into the enclosure.

In the particular embodiment shown in FIG. 4 of the drawings, the open bottom end of the riser 38 is coupled to communicating ducts 60 and 62 extending between the bottom end of the riser and the roof 64 and between the roof and the ceiling 66 of the enclosure, respectively. The bottom end of duct 62 opens to a vent opening 68 in the ceiling, and accordingly, the cooled air discharged from the cooler 10 is directed downwardly through the riser 38 and the ducts 60 and 62 into the enclosure.

It may also be seen in FIG. 4 that the cooler 10 is supported on the roof 64 of the enclosure by roof jacks 70 and 72 which cooperate to hold the cooler level. A channel mounting bar 74 is centered across the vent opening 68 and held firmly against the ceiling by bolts 76 which thread into the lower ends of brackets 78 secured at their respective upper ends to the riser by S-hooks 80. The vent opening 68, in turn, is covered by a grill 82 fastened to the mounting bar 74 by screws 84. Electrical service is coupled to the electric motor 52 on the blower and the electric water pump 22 through an operating mode selector switch 86 secured to the top side of the mounting bar 74. As illustrated in the drawings, an electrical line power cord 88 can be passed through a slot in the grill 82 to connect to the switch 86, or alternatively, the power cord can be directed through a grommet in the wall of duct 62 and run between the roof and the ceiling to an electrical outlet. A knob 90 located on the underside of the grill is coupled to the switch to enable the user to turn the cooler on and off as well as to select a desired operating mode. Thus, when the cooler is switched to the operating mode, alternating current electrical power is delivered to the motor 52 and the water pump 22 via connecting leads 92 and 94 extending from the switch 86 through respective rubber grommets 96 and 98 in the blower housing shroud 44.

Referring again to FIGS. 1–3, water is supplied to the reservoir defined by the bottom pan 12 and the riser 38 by means of a water line 100 connected externally of the cooler to a water supply. The water line 100 enters the cooler through an opening 102 provided for that purpose in one corner of the housing shell 14 and connects to a float actuated valve mechanism 104 mounted on a support arm 106 secured in the shell. A pivoted valve actuating rod 108 extends from the valve mechanism to attach to a float 110 in the reservoir and, in the conventional manner, open and close the valve 104 responsive to the level of the float to maintain a desired level of water in the reservoir. An overflow standpipe 112 communicates with an opening in the bottom wall 34 of the pan and is secured in position by a nut 114. If, for any reason, the float actuated valve mechanism is not effective to limit the level of water within the reservoir, the water level will rise until it reaches the top of the standpipe 112 whereupon the excess water will flow from the reservoir through the standpipe and to the ground through an optional tube (not shown) connected to the bottom end of the standpipe thereby preventing the water level in the reservoir from rising to a level where the electric pump motor is possibly damaged.

The water pump 22 is supported in the reservoir by a bracket 116 which slidably engages a lipped bracket receiving member 118 secured to the housing shroud 44 by a sheet metal screw 120. The inlet of the pump extends downwardly into the reservoir of water and opens at a location adjacent the bottom pan wall 34. A basket 122 comprising a fine mesh screen encircles the pump 22 and extends to the bottom of the pan to prevent sediment and other debris from being drawn into the pump inlet.

The outlet of the water pump 22, in turn, is coupled to the water distribution tube 24 overlying the evaporative media pad assemblies 20 by a flexible hose 124. For this purpose, a 90° angle hose connector 126 is provided at the distal end of the hose 124 to connect to a T-member 128 interposed in the line of the distribution tube. The water distribution tube 24 is generally rectangular in configuration and includes, for example, a capped T-member 130 in the side of the line opposite T-member 128 to facilitate its assembly. The distribution tube 24 thus assembled is adapted to overlie troughs 132 provided at the top edges of the evaporative media pad assemblies 20. A plurality of distribution outlets comprising short, somewhat flexible tubes 134 are provided at spaced intervals along the distribution tube 24 to direct water pumped from the reservoir into the troughs 132 and to support the tube on the troughs. As may be seen most clearly in FIGS. 3 and 6, each trough 132 is generally V-shaped in cross section with openings 136 being provided at spaced intervals along the bottom of each trough to allow the water distributed to the troughs by the overlying distribution tube to wet the evaporative media pads below. Dams 138 are also provided at intervals along the length of each trough between adjacent ones of the openings 136 to cause the water to be evenly distributed to the pads in the event the cooler is not perfectly level on the roof.

Each trough 132 also serves as the top member of a rigid peripheral frame of a corresponding one of the evaporative media pad assemblies 20. As illustrated in the drawings, and particularly in FIGS. 3 and 6, the frame of each pad assembly 20 also includes opposed side members 140 and 142 which are interconnected by the top trough member and by a bottom member 144. The outer, or front, wall of the trough is bent to provide a downwardly depending lip 146 which is adapted to hook over an upturned flange 148 spaced inwardly from the corresponding side wall 16 at the top of the shell by a horizontal flange portion 150, the lip 146 of the pad frame and the upturned flange 148 of the side wall cooperating to locate and support the pad assembly 20 at a spaced distance from the side wall. The front trough wall also includes an intermediate vertical wall portion 152 which rests against the upturned flange 148 and against which the water from the distribution outlet tubes 134 is directed downwardly to minimize splashing. The bottom horizontal pad frame member 144 is also generally V-shaped in cross section and provides downwardly depending flanges 154 and 156, and when the pad assembly 20 is installed in the cooler, the bottom edge of flange 154 rests on a bottom flange 158 of the shell and is held thereon by a lip 160 to further support the pad assembly in position.

Each pad assembly 20 further includes an evaporative media pad 162 comprising aspen wood shavings in an open weaved bag and an adjacent filter pad 164. The pad 162 and the filter 164 are held in place within the frame by spaced retaining wires 166 on the front side of the assembly having their respective top and bottom ends located in spaced holes in the trough 132 and the bottom frame member 144. A horizontal retaining bar 168 also extends between the opposed side frame members 140 and 142 on the front side of the assembly to press the spaced retaining wires 166 against the pad 162. On the back, or inner, side of the frame, wire retaining members 170 are provided to removably secure the pad and the filter in the frame. More particularly, the bottom ends of the wire retaining members 170 extend through and are thereby secured in openings provided at spaced intervals along the bottom frame member 144. A flange portion 172 depends downwardly from the back wall of the trough 132 to engage the top ends of the wire retaining members 170 when the various components comprising the pad assembly 20 are assembled, the retaining wires 170 being flexed to slip behind the flange 172 to removably secure the pad 162 and the filter 164 in the frame. Posts 174 also extend from the retaining members 170 into the pad and the filter to support them in the frame. Finally, openings 176 are provided at spaced intervals in the bottom member 144 to allow excess water to drain from the pad 162 back into the reservoir.

In accordance with one aforementioned aspect of the present invention, the side frame members 140 and 142 of each evaporative media pad assembly 20 are configured to provide outwardly facing V-shaped surfaces which slide in corresponding tracks provided in the one-piece, frameless housing shell to permit the pad assemblies to be installed and removed from above in a vertical direction.

To this end, angle bracket plates 178 and 180 are provided at each corner of the shell 14 at the top and the bottom thereof, respectively, and in particular, the base of each top bracket 178 is secured, such as by spot welding or the like, to the under side of the flanges 150 of adjacent side walls 16 while the base of each bottom angle bracket 180 is similarly secured to the upper side of the flanges 158 of adjacent side walls. In FIG. 2, it can be seen that the brackets provide respective surfaces 182 and 184 to which corresponding ends of a rail 186 having a T-shaped configuration in cross-section is secured by countersunk screws (not shown), spot welding or the like. Viewed from above, each T-shaped rail 186 is angled with respect to its adjacent side walls 16 to define, at the corresponding corner, a pair of adjacent tracks which are generally V-shaped in configuration with respect to the adjacent side walls. Thus, the rails 186 at adjacent corners of the one-piece, frameless shell defined opposed V-shaped tracks for receiving the V-shaped side frame members 140 and 142 of a corresponding evaporative media pad assembly 20, and the V-shaped side frame members slide in the tracks thereby permitting the pad assembly 20 to be easily installed or removed from above in a vertical direction. Accordingly, access to the pad assemblies for maintenance and repair is greatly enhanced.

In addition to providing means for locating and supporting the pad assemblies in the cooler housing, the tracks and the side members of the frame also cooperate to minimize leakage of ambient air around the pad thereby improving the efficiency of the cooler since substantially all the air discharged by the cooler is first cooled by passage through the wetted evaporative media pads. Air leakage is further minimized due to the cooperative effect between the lip 146 of the top trough member and the shell flange 148 and between the bottom frame member 144, including flange 154, and bottom shell flange 158. As a result, smaller pads can be used and the overall outside dimensions of the cooler, especially its height, can be reduced.

Access to the other components as well as the pad assemblies is also enhanced due to another aspect of the present invention whereby the top cover 18 is hinged to the shell 14 along one of the side walls thereof and means for latching the cover in the closed position are provided at the opposite side wall. In particular, the top cover 18 is similar in configuration to the bottom pan 12 and, in fact, may be initially stamped in the same manner. Angles 188 are secured at the bottom edges of a downwardly directed peripheral wall portion 190 of the cover to provide a flange 192 thereabout which extends inwardly to overlie the flange 150 of the side wall such that the top cover 18 is supported thereon when the cover is closed. Hinges 194 are provided to couple the top cover 18 to the shell along one edge thereof and allow the cover to be swung open, one leaf 196 of each hinge being secured to the flange 192 and the other hinge leaf 198 being fastened to the side wall flange 150. As illustrated by the ghosted lines in FIG. 3, the top cover can thereby be pivoted on the hinges to an open position to provide access to the interior of the cooler to facilitate maintenance and repair work. When the cover is swung to its closed position, it overlies the side walls of the shell and thus closes the cooler housing. Although two such hinges are shown in the drawings, it will be understood, however, that a single continuous hinge can be utilized or that more than the two hinges shown in the drawings may be used. Also, other suitable hinging mechanisms are available.

Figure 6:
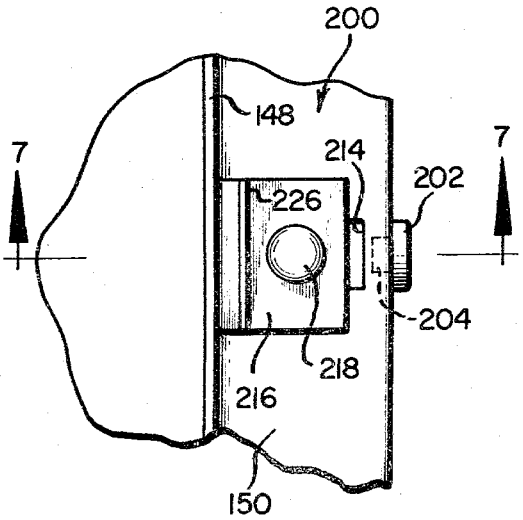
FIG. 6 is a partial top plan view of the latching mechanism with the top cover in the opened position.
Figure 7:
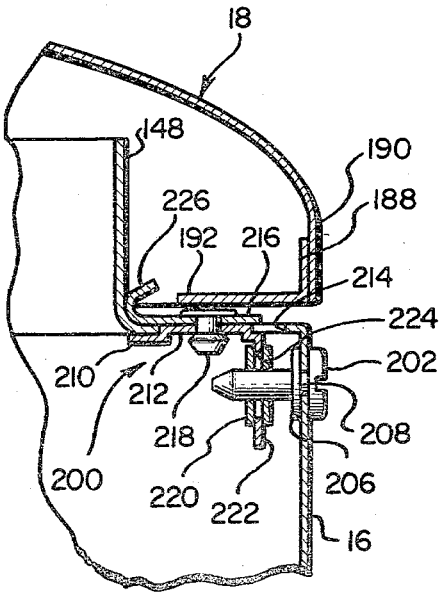
FIG. 7 is a sectional view taken along line 7—7 in FIG. 6 showing the latching mechanism in greater detail.

A quick release latch mechanism, identified generally at 200, is provided at the opposite edge of the cover to hold the cover in place in the closed position. As illustrated in FIGS. 6 and 7, the latch 200 includes a screw 202 which extends through an aperture 204 in the side wall just below the inwardly extending flange 150. The screw is trapped therein by a snap ring 206 fitted in place within a camber portion 208 of the screw, and accordingly, the screw 202 is secured to the side wall in a freely rotating manner. A lower right angle member 210 has a boss 212 on its upper surface which is adapted to fit and slide within an appropriately sized slot 214 in the side wall flange 150, and an upper latch member 216 secured by a rivet 218 or the like to the boss 212 rides on the upper surface of the flange 150 and holds the lower sliding member against the bottom side of the flange. A snap-on threaded clip 220 is positioned on the downturned portion 222 of the slide member and aligned with an opening 224 therein to threadably engage the screw 202. Thus, rotation of the screw, such as with a screwdriver, causes the latch member 216 to move relative to the side wall such that a lip 226 of the latch member is moveable to a position wherein it overlies the edge flange 192 of the cover to secure the cover in a closed position on the cooler housing. When access to the interior of the cooler is necessary, the screw 202 is turned in the opposite direction and the lip 226 of the latch member disengages the cover flange 192 to permit the cover to be pivoted to the open position.

Another important feature of this invention is the ease with which the blower 26 is secured on the riser 38 by the clamp shown in FIG. 8. In particular, the top edge of the riser 38 includes an out-turned horizontal flange portion 228 while the bottom edge of the blower housing has an out-turned horizontal peripheral flange 230 and a downturned lip 232 such that when the blower is positioned on the riser, the flanges 228 and 230 lap and abut one another. In a preferred embodiment, a soft seal gasket 234 is disposed between the two flanges and is folded to lap the mounting flange of a splash plate 236 which prevents water from being drawn into the air inlet openings of the blower. Opposed clamp members 238 and 240 having generally C-shaped configurations have respective flange portions 242 and 244 which straddle the riser flange 228 and the blower housing flange 230. The outer edges of the clamp members likewise provide abutting flanges 246 and 248, respectively, having spaced notches, or cutouts, 250 and tab sections 252 which cooperate to lock the clamp members together and prevent their lateral displacement relative to one another. Bolts 254 extend through aligned openings in the clamp members and through at least one opening in the splash guard to allow for the tight drawing down of the clamps against the blower housing and riser flanges to securely fasten them together. In the preferred embodiment, the cooperating flange and seal arrangement is continuous around the periphery of the riser between the riser and the blower housing, although only two pairs of opposed clamps need be used on opposite sides of the blower. Thus, the clamp provides a simple, yet effective device for releasably securing the blower to the riser which is easily accessible from above and eliminates the need for deformable tabs or sheet metal screws to hold the blower in position.

While a particular embodiment of the present invention has been shown and described, it will be obvious to those skilled in the art that various changes and modifications may be made without departing from the invention in its broader aspects. Accordingly, the aim in the appended claims is to cover all such changes and modifications which may fall within the true spirit and scope of the invention.

What is claimed is:

1. An evaporative cooler comprising in combination:

an outer housing comprising (a) a one-piece, frameless shell having open top and bottom ends and first and second pairs of opposed side walls having openings for admitting air into said housing, adjacent ones of said side walls defining corners of said shell, (b) a bottom pan closing the open bottom end of said shell, and (c) a top cover adapted to close the open top end of said shell;

means comprising a plurality of vertical rails generally T-shaped in cross section, each of said rails being secured in said shell at a corresponding one of said corners and angled with respect to the side walls adjacent said corner to define a V-shaped track for each of the adjacent side walls at said corner, the rails at adjacent ones of said corners cooperating to define opposed V-shaped tracks between adjacent corners of said shell, said opposed tracks being spaced inwardly from said side walls;

a plurality of evaporative media means adapted to be received through the open top end of said shell in slidable engagement between corresponding ones of said opposed V-shaped tracks and held thereby in spaced relation to the corresponding side walls, each of said evaporative media means having a pair of peripheral track engaging sides having V-shaped outer surfaces complementary to said V-shaped tracks;

means for supplying water to said evaporative media means to wet said evaporative media means; and air moving means mounted in said housing and having a discharge outlet opening through said housing, said air moving means drawing ambient air into said housing through said side wall openings and said wetted evaporative media means to cool said air by evaporation of water from said wetted evaporative media means, said air moving means discharging the cooled air through said discharge outlet.

2. An evaporative cooler in accordance with claim 1 wherein each of said evaporative media means comprises an evaporative media pad and a peripheral frame for supporting said evaporative media pad, said frame comprising a pair of side frame members providing said V-shaped outer surfaces, trough means extending between said side frame members and overlying said evaporative media pad for receiving water from said water supplying means and discharging the water to wet said evaporative media pad, and a bottom frame member extending between said side frame members below said evaporative media pad.

3. An evaporative cooler in accordance with claim 2 wherein each of said side walls includes a continuous peripheral flange depending inwardly and thence upwardly from the top end of said shell to provide an upstanding flange portion spaced inwardly from said side wall, wherein said trough means includes a downwardly depending lip extending the length thereof and adapted to hook over said upstanding top flange portion, and wherein each of said side walls includes a continuous peripheral flange depending inwardly from the bottom end of said shell to engage said bottom frame member, said downwardly depending trough lip cooperating with said upstanding top flange portion, said inwardly depending bottom flange cooperating with said bottom frame member, and the V-shaped surfces of said side frame members cooperating with said V-shaped tracks to minimize leakage air flow into said housing.

4. An evaporative cooler in accordance with claim 1 including brackets secured to said shell at each of said corners and adjacent the top and bottom ends of said shell for mounting said vertical rails to said shell and for spacing said evaporative media means in the opposed tracks provided by said rails a predetermined distance inwardly from said side walls.

5. An evaporative cooler in accordance with claim 1 wherein said bottom pan includes an opening coincident with the discharge outlet of said air moving means and through which said cooled air is discharged.

6. An evaporative cooler in accordance with claim 1 wherein one of said side walls includes an opening coincident with the discharge outlet of said air moving means and through which said cooled air is discharged.

7. An evaporative cooler in accordance with claim 1 wherein a plurality of air directing louvers are provided in each of said side walls.

* * * * *